United States Patent [19]

Kamegaya et al.

[11] Patent Number: 4,554,482

[45] Date of Patent: Nov. 19, 1985

[54] DC TYPE GAS DISCHARGE DISPLAY PANELS

[75] Inventors: Takeo Kamegaya; Satoshi Watanabe, both of Tokyo, Japan

[73] Assignee: Okaya Electric Industries Co., Ltd., Tokyo, Japan

[21] Appl. No.: 321,965

[22] Filed: Nov. 16, 1981

[30] Foreign Application Priority Data

Apr. 28, 1981 [JP] Japan ..... 56-64621

[51] Int. Cl.[4] ..... H01J 61/06

[52] U.S. Cl. ..... 313/582; 313/346 R; 313/630

[58] Field of Search ..... 313/633, 582, 484, 585, 313/586, 587, 630, 346 R; 427/123, 126.1, 126.3, 126.4; 252/515, 521

[56] References Cited

U.S. PATENT DOCUMENTS

| | | | |
|---|---|---|---|
| 3,743,879 | 7/1973 | Kupsky | 313/484 |
| 3,899,707 | 8/1975 | Sasaki et al. | 313/582 |
| 3,904,905 | 9/1975 | Watanabe et al. | 313/586 X |
| 3,959,683 | 5/1976 | Kupsky | 313/582 |
| 4,126,809 | 11/1978 | Wedding et al. | 313/587 |
| 4,359,663 | 11/1982 | Shinoda et al. | 313/582 |
| 4,393,326 | 7/1983 | Kamegaya et al. | 313/582 |

*Primary Examiner*—David K. Moore
*Assistant Examiner*—K. Wieder
*Attorney, Agent, or Firm*—Sughrue, Mion, Zinn, Macpeak & Seas

[57] ABSTRACT

A DC gas discharge display panel is described, having a cathode which is formed by depositing a metal and/or a metal compound on a substrate of the DC gas discharge display panel or a cathode substrate by the application of plasma spray utilizing plasma generated by the discharge of a rare gas, or a mixed gas of a rare gas and hydrogen and/or nitrogen.

3 Claims, 6 Drawing Figures

DC TYPE GAS DISCHARGE DISPLAY PANELS

FIELD OF THE INVENTION

The present invention relates to DC type gas discharge display panels having a flat structure, such as character display panels in which electrodes are disposed in a matrix form and bar graph display panels in which electrodes in strip form are disposed in parallel to one another, and more particularly, to DC type gas discharge display panels provided with electrodes which are produced by plasma spray. These DC type gas discharge display panels are hereinafter referring to as "DC-PDP".

BACKGROUND OF THE INVENTION

In the conventional DC-PDP wherein light-emission generated by cold cathode discharge is utilized for display, the discharge initiation voltage and discharge maintaining voltage are high. Therefore, not only is it difficult to connect such DC-PDP directly to peripheral circuit elements such as LSI, but also a large output is required for obtaining sufficient display light-emission. This leads to a reduction in the efficiency of the conventional DC-PDP. The reason for this is that in the conventional DC-PDP, cathode materials having a high work function, such as iron, nickel, chromium and alloys thereof are used, and hence the cathode fall voltage constituting the major portion of discharge voltage in the cold cathode discharge is increased.

As a method of decreasing the cathode fall voltage, materials having low work functions are often used for the preparation of cathodes. Furthermore, since the cathode is always subject to ion collision during the operation, it is necessary that cathode materials be used which have high abrasion resistance against ion collision. However, when materials having high melting points and suitable for use as the cathodes are selected from cathode materials having low work functions and high abrasion resistance against ion collision, it is difficult to prepare the cathode by conventional methods such as printing, vapor-deposition and plating.

One of the reasons for this diffuculty is that when a high melting point material as described above is converted into ink form by the use of a vehicle and printed on the substrate of DC-PDP or cathode substrate by thick film printing, it is necessary to melt the high melting point material by heating at high temperatures and to deposit it onto the substrate, but the heating of a DC-PDP having a thin and broad flat structure at such high temperatures may cause the deformation of the structure. Hence a sufficient heat treatment cannot be applied, giving rise to the problem that metal particles of the high melting point material are only weakly bonded together.

Also, in the case of vapor-deposition or plating, it is not possible to prepare a cathode having a sufficient thickness, and hence the cathode formed has poor durability and a short service life.

SUMMARY OF THE INVENTION

As a result of extensive studies, it has been found according to this invention that the foregoing problems can be solved by depositing a high melting point material onto a substrate of a DC-PDP or onto a cathode substrate in a molten state by the application of a plasma spray utilizing plasma generated by the discharge of a rare gas or a mixed gas of rare gas and hydrogen and/or nitrogen.

The present invention, therefore, provides a DC type gas discharge display panel provided with a cathode wherein said cathode is formed by depositing a metal, a metal compound or a mixture thereof onto a substrate of said DC type gas discharge display panel, or onto a cathode substrate, by a plasma spray technique utilizing plasma generated by the discharge of a rare gas, or a mixed gas of a rare gas and hydrogen and/or nitrogen.

DESCRIPTION OF THE PREFERRED EMBODIMENTS

Figure 1:
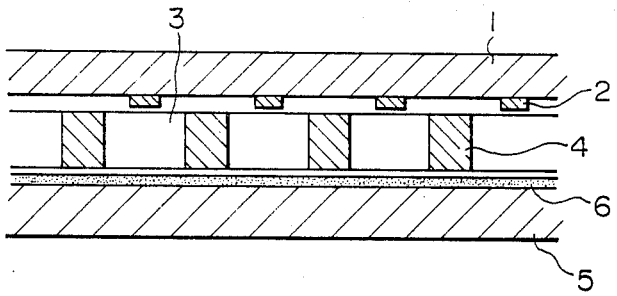
FIGS. 1 and 2 are a cross-sectional view and a fragmentary perspective view, respectively, of an embodiment of the invention.

In accordance with the invention, a material having a low work function and a high abrasion resistance against ion collision is employed to form the cathode, and therefore, it is possible to obtain a DC-PDP which has not only a low operating voltage and a low electric power consumption, but also a long service life.

The plasma spray for use in the invention will first be explained briefly.

The term "plasma spray" refers to a method in which a spray material, such as a metal or a metal compound, is introduced into a plasma jet, melted by the high heat of the plasma jet, and is sprayed onto an object by the high-speed spray. The plasma jet for use in the plasma spray is produced by introducing a gas under a high pressure into an arc discharge generated between the anode and cathode of a spray gun to thereby form a plasma fluid, raising the temperature of the plasma by the thermal pinch phenomenon generated by compressing the plasma fluid toward the center thereof, and jetting the plasma fluid as a supersonic and high temperature (several thousand to several ten thousand degrees centigrade) plasma through a nozzle of a spray gun. This spray method is characterized in that a high melting point spray material can be melted and deposited onto an object without heating the object to an excessively high temperature.

Cathode materials which can be used in the invention, i.e., those materials having a low work function, a high abrasion resistance against ion collision, and a high melting point, include tetra- and hexa-borides of rare earth elements ($YB_4$, $GdB_4$, etc., and $YB_6$, $LaB_6$, $CeB_6$, $GdB_6$m etc.), oxides of rare earth elements ($Y_2O_3$, $La_2O_3$, $CeO_2$, $Gd_2O_3$, $TbO_2$, etc.), oxides of alkaline earth metals (MgO, SrO, etc.), and composite compounds of oxides of alkaline earth metals and molybdates, tungstates, or aluminates ($aMgO.bAl_2O_3$, $aBaO.bSrO.cAl_2O_3$, etc.). Of these materials, the borides of rare earth elements are electrically conductive, whereas the oxides of rare earth elements, the oxides of alkaline earth metal elements, and the composite compounds containing the oxides of alkaline earth metal elements are electrically insulative.

The oxides of alkaline earth metal elements, and the composite compounds of the oxides of alkaline earth metal elements and the molybdates, tungstates or aluminates of alkaline earth metal elements can be obtained by decomposing the carbonates, molybdates, tungstates or aluminates of alkaline earth metal elements, respectively, by plasma spray. The resistance to ion collision of a plasma sprayed layer of one of the foregoing composite compounds is higher than that of a plasma sprayed layer of one of the foregoing oxides.

Examples of pure metals having high abrasion resistance against ion collision include molybdenum (Mo), and tungsten (W). Aluminum (Al) also has a high abrasion resistance against ion collision since a thin layer of alumina ($Al_2O_3$) is usually formed on the surface of aluminum. However, Mo, W and Al with a thin $Al_2O_3$ layer formed thereon have high work functions.

In accordance with the invention, a cathode and/or an anode is formed by depositing a metal and/or a metal compound as described above on a substrate of the DC-PDP and/or an electrode substrate by a plasma spray generated by the discharge of a rare gas, or a mixed gas of a rare gas and hydrogen and/or nitrogen, without raising the temperature of the substrate to high levels.

In the formation of the anode and/or cathode according to the invention, emitter materials having a low work function, low electrical conductivity and a high resistance against ion collision and which are selected from the above-described cathode materials are used singly or in combination with non-emitter materials which are electrically conductive and have a high resistance against ion collision, but have a high work function. For example, the tetra- or hexa-borides of rare earth elements are used singly or in combination with each other. Alternately, the tetra- and hexa-borides of rare earth elements, and mixtures thereof, are used in admixture with Mo, W, Al with a thin layer of $Al_2O_3$ formed on the surface thereof, and mixtures thereof. These materials are deposited on a DC-PDP substrate and/or a cathode substrate by plasma spray.

Emitter materials having electrical insulation properties and high abrasion resistance to ion collision are used as cathode materials in admixture with those emitter materials having electrical conduction properties and high abrasion resistance to ion collision, or those non-emitter materials having electrical conduction properties and high abrasion resistance to ion collision, or mixtures thereof. For example, the oxides of rare earth elements, or the oxides of alkaline earth metal elements, or mixtures thereof, or the composite compounds of the foregoing oxides and the molybdenites, tungstates or aluminates of alkaline earth metal elements, or mixtures thereof, are mixed with the tetra- or hexa-borates of rare earth elements, or mixtures thereof, Mo, W or Al with a thin film of $Al_2O_3$ provided on the surface thereof, or mixtures thereof, or a mixture of the borates and metals, and the resulting mixture is applied by plasma spray to form a deposited layer.

With regard to the mixing ratio of the above described materials, in the case of mixing electrically conductive materials and electrically insulative materials, it is necessary to add the electrically conductive material so that it constitutes 60% or more of the total volume. In the case of mixtures of emitter materials and non-emitter materials, the mixing ratio is not critical and can be determined approximately, although the discharge voltage characteristics are improved as the emitter material content is increased.

The thickness of the deposited layer is required to be 1 micron or more for purposes of durability or service life. The upper limit of the thickness is limited by the display disolution ability of the DC-PDP. From a service life standpoint, a thickness of about 100 microns is sufficient, and it may be larger than 100 microns as long as it does not deteriorate the display properties. (In plasma spray, a thickness of about 300 microns may be used.)

Although the material to be sprayed is generally in the form of a bar, a wire or powder, it is preferred in the invention to use powdery materials since these are more easily mixed.

Although the foregoing explanation has been made only with respect to the use of plasma spray for the formation of cathode emitters, the plasma spray can also be employed for the formation of the anodes.

By depositing materials heretofore used, such as pure metals of iron, nickel, chromium, etc., and mixtures thereof, on a DC-PDP substrate by plasma spray, a cathode substrate can be formed while at the same time forming an anode. The cathode substrate is indicated by the reference number 10 in FIGS. 3 to 6. The anode is preferably thick since it is also subject to cation collision. The plasma spray is advantageous over vapor-deposition and other conventional techniques in that it permits the thickness of the anode to be increased. Furthermore, the plasma spray is advantageous over conventional etching, printing, plating and vapor-deposition methods in that when it is necessary to form an anode in a groove it can be formed more simply.

As a gas for plasma for use in the plasma spray of this invention, a reducing gas is used since it is necessary to control the chemical action of the gas on the spray material. That is, in this invention, the electrode formed by the plasma spray deposition is required to be electrically conductive. Therefore, in order to prevent the oxidation caused by the plasma gas, or the oxidation caused by air introduced during the spray, a rare gas or a reducing gas composed mainly of a rare gas is used. In more detail, a rare gas or a mixed gas of a rare gas and hydrogen and/or nitrogen is used. In particular, a mixed gas of argon and hydrogen provides good results. In this mixed gas, the argon is readily ionized since it is a large atom compared with other inert gases, resulting in ready gas expansion, and the hydrogen has the effects of enhancing the reducing properties of the gas and of raising the plasma temperature.

The invention will hereinafter be explained in greater detail by reference to the accompanying drawings.

Figure 2:
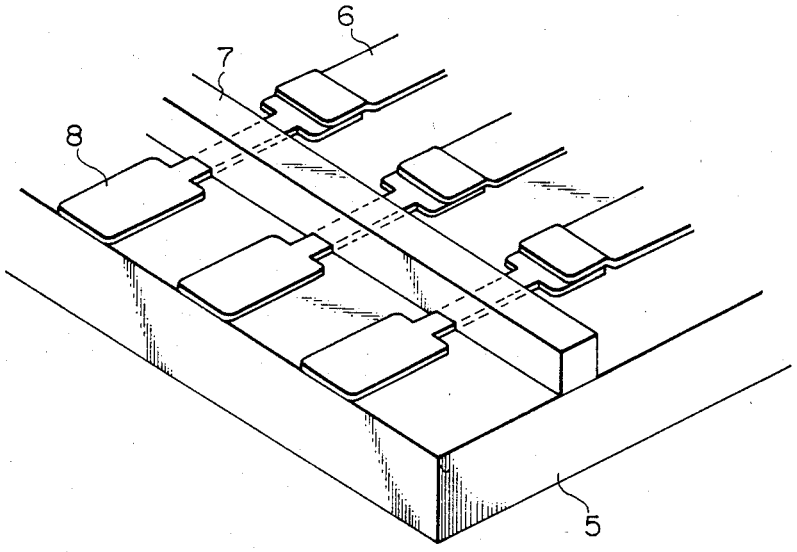

FIGS. 1 and 2 are a cross-sectional view and a perspective view, respectively, of an embodiment of a DC-PDP of the invention. In FIGS. 1 and 2, the DC-PDP comprises a front substrate 1, an anode 2 provided on the inner surface of the front substrate 1, a discharge space 3, a spacer 4 to form the discharge space 3, a back substrate 5, and a cathode 6 provided on the inner surface of the back substrate 5 in such a manner that the anode 2 and cathode 6 cross with each other.

The cathode 6 is composed mainly of an emitter material as described above and is formed by a plasma spray technique. The anode 2 is made of a metal, such as iron, nickel, and chromium, or a mixture thereof, or is composed of a transparent electrically conductive film (nesa film), and it may be formed either by the plasma spray technique, or by the conventional etching, thick film printing, plating or vapor-deposition methods.

The deposited layer formed by the plasma spray often becomes porous depending on the spray conditions and spray material. In order to prevent leakage, therefore, it is desirable to connect a conductive portion 8, formed by a method other than the plasma spray, to a seal portion 7 between the front substrate 1 and the back substrate 5.

Figure 3:
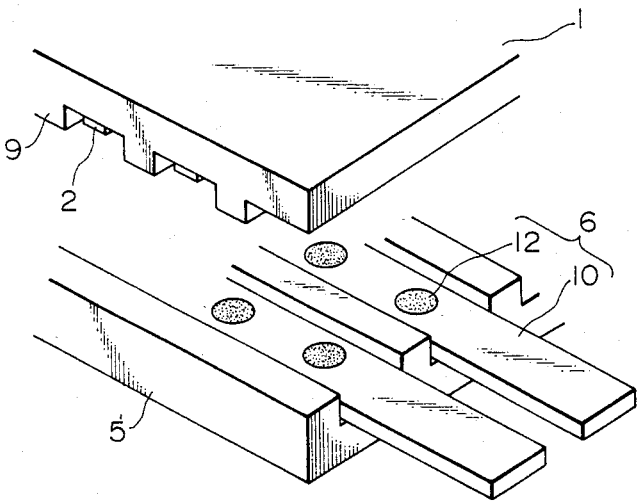
FIGS. 3 and 4 are a fragmentary perspective view and a cross-sectional view, respectively, of another embodiment of the invention.
Figure 4:
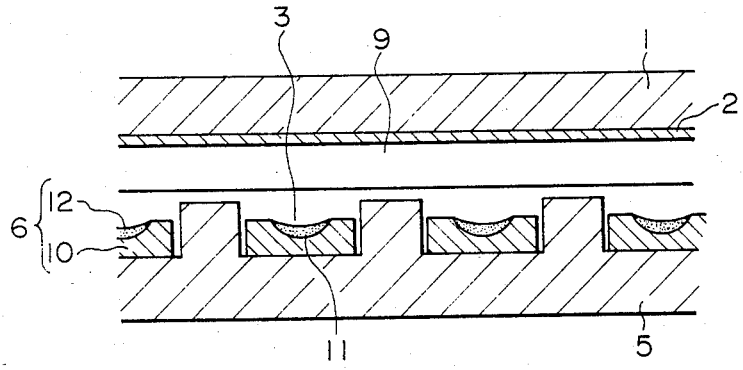

FIGS. 3 and 4 are a fragmentary perspective view and a cross-sectional view, respectively, of another embodiment of the DC-PDP of the invention. In this DC-PDP, an anode 2 provided on the inner surface of a front substrate 1 and a cathode 6 provided on the inner surface of a back substrate 5 are disposed in such a manner that the anode 2 and the cathode 6 cross with each other through a discharge space 3 formed by a barrier 9 provided on the inner surface of the front substrate 1. In the cathode 6 of this embodiment, an approximately 75 to 100 micron thick ribbon-like cathode substrate 10, which is formed using a 42–6 alloy (alloy of Fe, Ni and Cr) by etching, is provided with a concave area 11 at the surface from which a current is discharged, and an emitter material as described above is deposited in the concave area 11 by plasma spray to form an emitter 12. Although the anode 2 and cathode substrate 10 can be simply formed by plasma-spraying a metal as described above, they can also be formed by other techniques such as printing, vapor-deposition and plating, or by etching as in this case.

Figure 5:
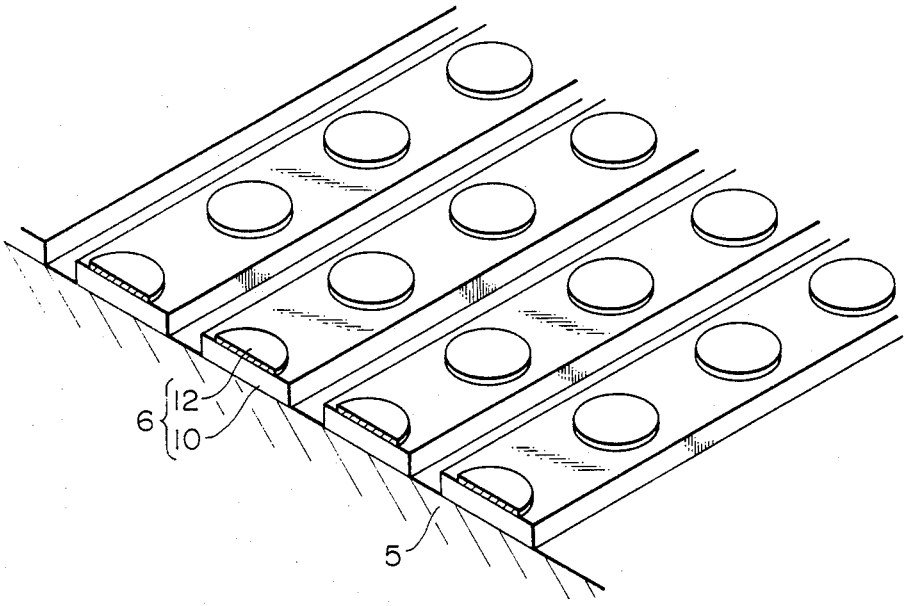
FIGS. 5 and 6 are each a perspective view showing only a cathode of another embodiment of the invention.

FIG. 5 is perspective view of another embodiment of the DC-PDP of this invention. In this embodiment, a cathode substrate 10 is formed on a back substrate 5 by plasma spray, and an emitter material as described above is deposited on the cathode substrate 10 at a position corresponding to a discharge cell by plasma spray to form an emitter 12. The cathode substrate 10 is made of iron, nickel, chromium or a like metal, or a mixture thereof, and it may be formed either by plasma spray or by the conventional methods.

Figure 6:
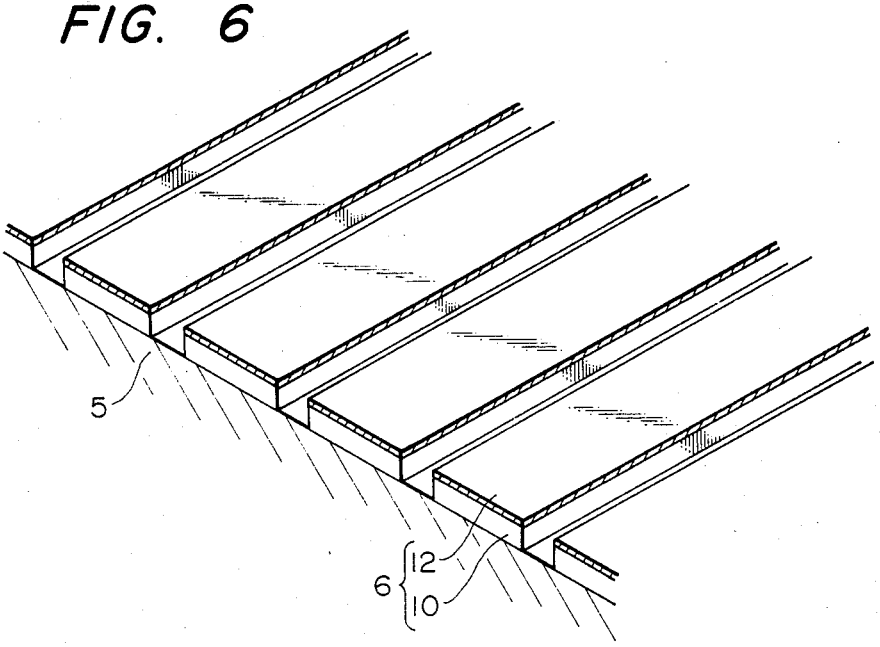

FIG. 6 is a perspective view of a cathode of another embodiment of the DC-PDP of this invention. In this embodiment, a cathode substrate 10 is formed on a back substrate 5, and an emitter 12 is formed on the cathode substrate 10 by plasma spray to provide a cathode 6. The cathode substrate 10 is formed by the same method as used in the embodiment shown in FIG. 5.

In accordance with this invention, as described above, a cathode material having a low work function and an abrasion resistance to ion collision, which could not be used for the formation of a cathode of DC-PDP because of its high melting point, can be deposited on a substrate of the DC-PDP or on a cathode substrate by plasma spray to provide a cathode as a thick and strong deposited layer, and since a strong reducing gas is selected as a gas for the plasma, oxidation of the deposited layer can be prevented. Therefore, a DC-PDP can be obtained which can be driven at a low voltage and has a long service life or durability. Furthermore, by depositing a metal or a metal mixture on a substrate of the DC-PDP by plasma spray, an anode or a cathode substrate can be formed as a thick and strong deposited layer.

It goes without saying that the invention is not limited to the embodiments as described above, and various modifications and changes can be made without departing from the scope of the invention as described in the appended claims.

What is claimed is:

1. A DC type gas discharge display panel having a cathode comprised of a mixture of a tetra- or hexaboride of a rare earth element or a mixture thereof, and molybdenum, tungsten, aluminum with a thin film of aluminum oxide provided on the surface thereof, or a mixture thereof.

2. A DC type gas discharge display panel having a cathode comprised of a tetra- or hexa-boride of a rare earth element, or a mixture thereof, and oxides of rare earth elements.

3. A DC type gas discharge display panel, as claimed in claim 2, wherein said cathode further comprises at least one of the materials comprising oxides of alkaline earth metal elements, composite compounds of oxides of alkaline earth metal elements and molybdenites, tungstates, aluminates of alkaline earth metal elements, molybdenum, and tungsten and aluminum with a thin film of aluminum oxide provided on the surface thereof.

* * * * *